United States Patent [19]

Hübner

[11] Patent Number: 4,491,282

[45] Date of Patent: Jan. 1, 1985

[54] WINDING MACHINE FOR AUTOMATIC SPOOL EXCHANGE

[75] Inventor: Diethard Hübner, Bordesholm, Fed. Rep. of Germany

[73] Assignee: Neumünstersche Maschinen- und Apparatebau Gesellschaft mbH (Neumag), Neumuenster, Fed. Rep. of Germany

[21] Appl. No.: 408,660

[22] Filed: Aug. 16, 1982

[30] Foreign Application Priority Data

Aug. 20, 1981 [DE] Fed. Rep. of Germany ..... 3132853

[51] Int. Cl.[3] ..... B65H 54/02; B65H 67/04

[52] U.S. Cl. ..... 242/18 A; 242/18 PW

[58] Field of Search ..... 242/18 A, 18 PW, 25 A

[56] References Cited

U.S. PATENT DOCUMENTS

| | | | |
|---|---|---|---|
| 3,708,133 | 1/1973 | McErlane et al. | 242/18 A |
| 3,856,222 | 12/1974 | Wust | 242/18 A |
| 3,876,161 | 4/1975 | Miller | 242/18 A |
| 3,907,217 | 9/1975 | Graf et al. | 242/18 PW |
| 3,913,852 | 10/1975 | Lenk et al. | 242/18 A |
| 3,999,715 | 12/1976 | Schippers et al. | 242/18 A |
| 4,033,519 | 7/1977 | Abe et al. | 242/18 A |
| 4,155,512 | 5/1979 | Bauch et al. | 242/18 PW X |
| 4,186,890 | 2/1980 | Miller | 242/18 PW X |
| 4,216,920 | 8/1980 | Tambara et al. | 242/18 A |

*Primary Examiner*—Stanley N. Gilreath

*Attorney, Agent, or Firm*—Michael J. Striker

[57] ABSTRACT

A winding machine for automatic spool exchange has a spool switching element with alternately operating clamping pins for receiving spool sleeves, a traverse motion guiding element, an element for removing threads from the traverse motion guiding element and their displacing from a traverse motion region to a knot winding region, and elements shiftable during spool exchange to their operational position and including an upper axis-parallel thread guiding member with an abutment in the knot winding region, a lower axis-parallel thread guiding member with a further abutment in the traverse motion region, a finger displaceable along the upper guiding member to the vicinity of the first mentioned abutment, and a further finger displaceable outwardly along the lower thread guiding member to over an end of a sleeve.

5 Claims, 11 Drawing Figures

WINDING MACHINE FOR AUTOMATIC SPOOL EXCHANGE

BACKGROUND OF THE INVENTION

The present invention relates to winding machines for automatic spool exchange.

Winding machines of this general type are known in the art. One such machine is disclosed, for example, in German Auslegeschrift No. 2,733,120. For lifting and displacing the thread during spool exchange above and below the position of the clamping pin provided with the new sleeve, catching hooks are arranged which are turnable about an approximately vertical axis. This construction possesses, however, certain disadvantages. It has been found in practice that, particularly because of the turning through of the catching hooks, the thread guidance is not sufficiently accurate. It is not always guaranteed that on the new sleeve the thread end is wound over by the knotting coil. It hangs arbitrarily free outside and can be caught during the spool ejection.

SUMMARY OF THE INVENTION

Accordingly, it is an object of the present invention to provide a winding machine which avoids the disadvantages of the prior art.

More particularly, it is an object of the present invention to provide a winding machine which guarantees an exact thread guidance during spool exchange, so as to avoid the above described disadvantages.

In keeping with the above described objects, and with others which will become apparent hereinafter, one feature of the present invention resides, briefly stated, in a winding machine which is additionally provided with means shiftable during spool exchange to their operational position and including an upper axis-parallel thread guiding member with an abutment in a knot winding region, a lower axis-parallel thread guiding member with further abutment in a transverse motion region, a finger displaceable along the upper guiding member to the vicinity of the first mentioned abutment, and a further finger displaceable outwardly along the lower thread guiding member to over an end of a sleeve.

When the winding machine is designed in accordance with the present invention it provides for accurate guidance of threads during the spool exchange.

In accordance with a further feature of the present invention, the upper and lower thread guiding members of the shiftable means are formed a front edges of turnable sheet members.

Still a further advantageous feature of the present invention is that guiding rods with axially displaceable rings arranged thereon are provided, wherein the feed members are connected with the guiding rods and the first mentioned and further fingers are mounted on the rings and turnable by turning the guiding rods together with the sheet members.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
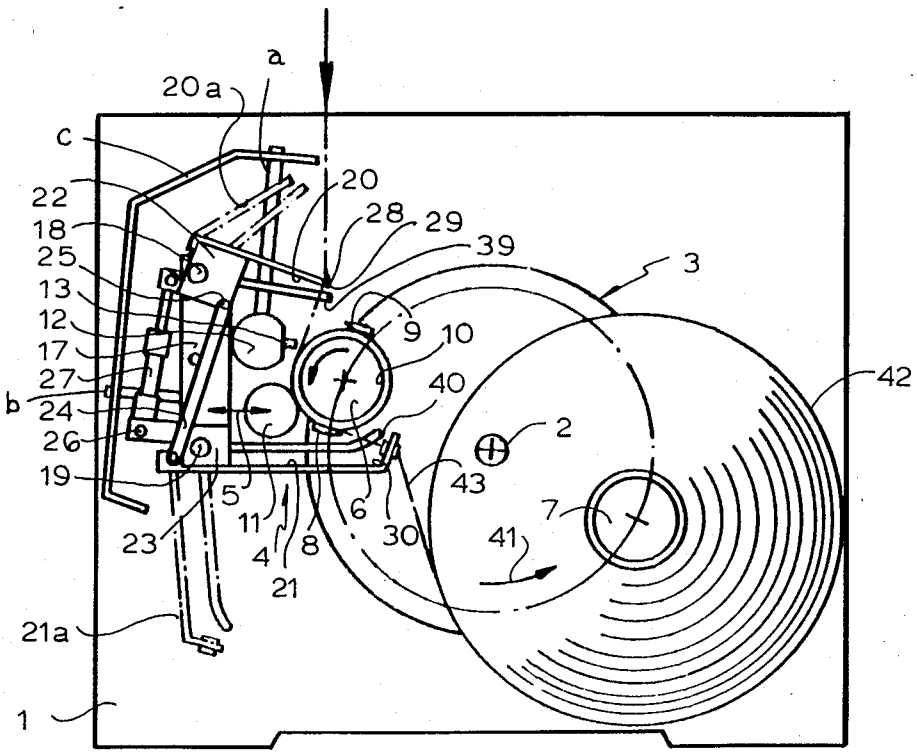
FIG. 1 is a side view showing a winding machine in accordance with the present invention.

A winding machine in accordance with the present invention includes, as known in the art, a housing 1, a spool switching element 3 supported on the housing 1 rotatable about its axis 2, and a carriage 4 which for correspondence with the respective spool diameter is reciprocable normal to the axis 2 as indicated by the double arrow 5.

The spool switching element 3 is provided with two diametrically opposite clamping pins 6 and 7 for receiving spool sleeves. On the clamping pins 6 and 7, and more particularly at their ends close to the support, two diametrically opposite hook-shaped knives 8 and 9 are arranged and engage over the edge of an attachable sleeve 10. Thereby the knife holder forms an abutment for the sleeve 10. For the sake of simplicity, an example is shown in the drawing, in which on each clamping pin only one sleeve or spool is arranged. It is to be understood that it is also possible to arrange several sleeves adjacent to one another on each clamping pin. In correspondence with the number of sleeves provided, several knives are arranged along the clamping pin and displaceable in the interior of the clamping pins 6 and 7 during spool exchange, as disclosed in the above mentioned German Auslegeschrift No. 2,733,120.

A traverse motion device 12 with a traverse motion thread guide 13 is arranged on the carriage 4 above a pressing roller 11. The traverse motion region is limited by broken lines 14 and 15 in FIG. 2. As known, the traverse motion region ends particularly at a side facing toward the housing 1 at a certain distance from the edge of the installed sleeve 10. The sleeve region which is not overlapped by the traverse motion, or in other words the region between the plane of the knives 8 and 9 and the proximal end of the transverse motion region, is a so-called knot winding region 16.

A stationary thread guide, for example a guide ear, is arranged above the carriage 4 in the center of the traverse motion region. It is not shown in the drawing, inasmuch as it is located relatively high. The thread is supplied in the shown example from above. It is to be understood that the invention is also suitable for automatic winding machines in which the thread is supplied, for example, laterally. For simplification, the direction from which the thread is supplied is identified as "above". In the corresponding sense, the terms "below", "over", and the like, are used.

An approximately vertically extending strip 17 is arranged at each side of the carriage 4. Two round guiding rods 18 and 19 are supported in both lateral strips. One of the guiding rods is arranged above the plane of the axis of the associated clamping pin 6, whereas the other guiding rod is arranged below this plane. Sheet members 20 and 21 are fixedly connected with both guide rods 18 and 19 by lateral holding plates 22 and 23. The sheet members 20 and 21 engage in their approximately horizontal engaging position shown in solid lines in FIG. 1, around the clamping pin 6 provided with an empty sleeve 10 in a tongue-like manner at a distance therefrom.

The holding plates 22 and 23 are connected with one another by a hinged coupling rod 24. A hinge 25 lies on the upper holding plate 22 at one side of the plane defined by both rod axes, whereas a hinge 26 on the lower holding plate 23 lies at the other side of this plane. Moreover, a piston of a cylinder-and-piston unit 27 engages the holding plate 22 and is hinged on the base plate of the carriage 4. By actuating the cylinder-and-piston unit 27, both sheet members 20 and 21 are turned back simultaneously to approximately vertical positions **20*a* and 21*a***, identified by broken lines.

A front edge 28 of the upper sheet member 20 which extends substantially over the entire length of the clamping pin 6 runs parallel to the axis of the clamping pin 6. In the engaging position, it lies substantially in the center over the connecting line between the traverse motion thread guide 13 and the axis of the clamping pin 6. It is provided substantially in the center of the knot winding region 16 with a hook-shaped springy abutment 29.

A front edge 30 of the lower sheet member 21 extends similarly parallel to the axis of the clamping pin 6. It lies substantially in a vertical tangential plane of the clamping pin 6, facing away from the carriage 4. It is also provided with a hook-shaped springy abutment 31 which, however, lies in the traverse motion region and out not far from the center.

A cylinder-and-piston unit 32 with a piston rod 33 is arranged between both rods 18 and 19 and carries a traverse 34. The traverse 34 has ends extending toward the rods 18 and 19, and two rings 35, 36, 37, 38 are mounted on these ends. The rings 35 and 37 are arranged at one side of the traverse, whereas the rings 36 and 38 are arranged at the other side thereof. The rings are seated on the rods 18 and 19 and are movable relative to them in longitudinal direction, but are not rotatable relative thereto.

Figure 2:
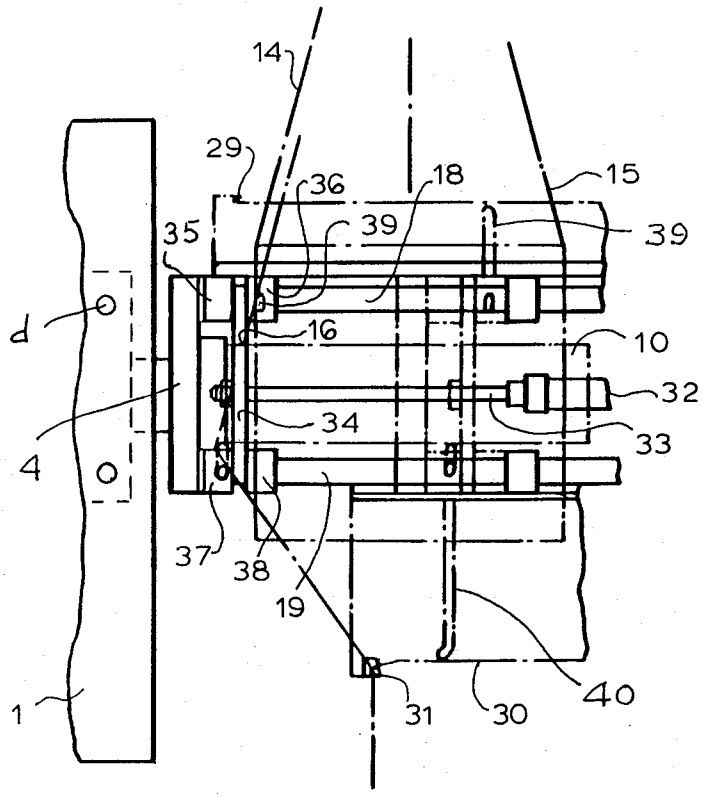
FIG. 2 is a partial plan view wherein parts which are not important for the present invention are removed for the sake of clarity.

A finger 39 is mounted on the ring 36, which is arranged on the upper rod 18 in FIG. 2 at the right side of the traverse 34. Similarly, a finger 40 is mounted on the ring 37, which is arranged on the lower rod 19 in FIG. 2 at the left side of the traverse, and inclined relative to the finger 39. The fingers 39 and 40 are normal to the rods 18 and 19 and extend in the engaging portion approximately horizontally from the carriage 4 in direction to the spool shifting element 3 and extend outwardly with their free ends to over the edges 28 and 30. During turning back of the sheets 20 and 21 in the inoperative positions **20*a* and 21*a*, the fingers 39 and 40 are retained because of their non-rotatable arrangement relative to the rods 18 and 19, their relative position to the sheet members 20 and 21. In other words, the free ends of the fingers 39 and 40, and particularly the upper finger, are located at a short distance from the edges 28 and 30**.

Figure 3:
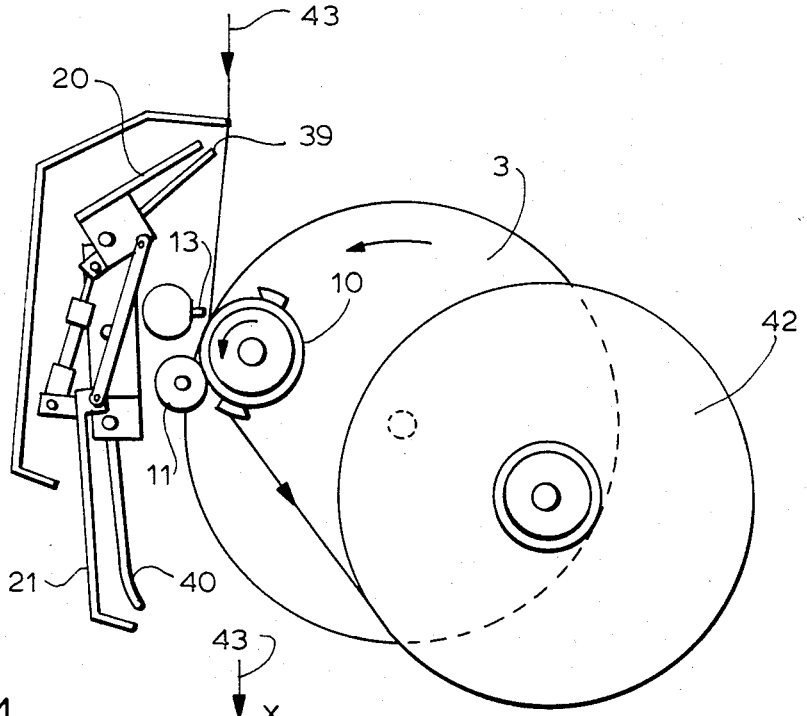
FIGS. 3–10 show schematic views of the inventive winding machine in several successive working positions.

In normal winding operation, the sheet members 20 and 21 and the fingers 39 and 40 are in the turned back position, in which they perform no functions. A shown in FIG. 2 in broken lines, the fingers 39 and 40 run over the center of the traverse motion region delimited by dash-dot lines 14, 15. When during operation the spool at the left side in FIG. 1 is full, the spool shifting element 3 turns in direction of arrow 41 by 180°, so that the full spool travels to the right. It is identified in this position by a circular line 42. The carriage 4 which before this was in contact with the full spool and therefore was withdrawn far to the left in FIG. 1, moves in direction to the empty spool sleeve 10 of the other clamping pin 6, which is now turned in the operational position. The pressing roller 11 comes to abutment against the spool sleeve 10. The thread 43, which is guided now by the traverse motion thread guide 13 as shown in FIG. 3 moves transversely over the empty rotatable spool sleeve 10 in an axial direction in a reciprocatory motion. It is however not wound on the sleeve 10, but instead partially guided around it, and during further traverse motion is wound on the full spool 42 which rotates further as a result of inertia.

Figure 4:
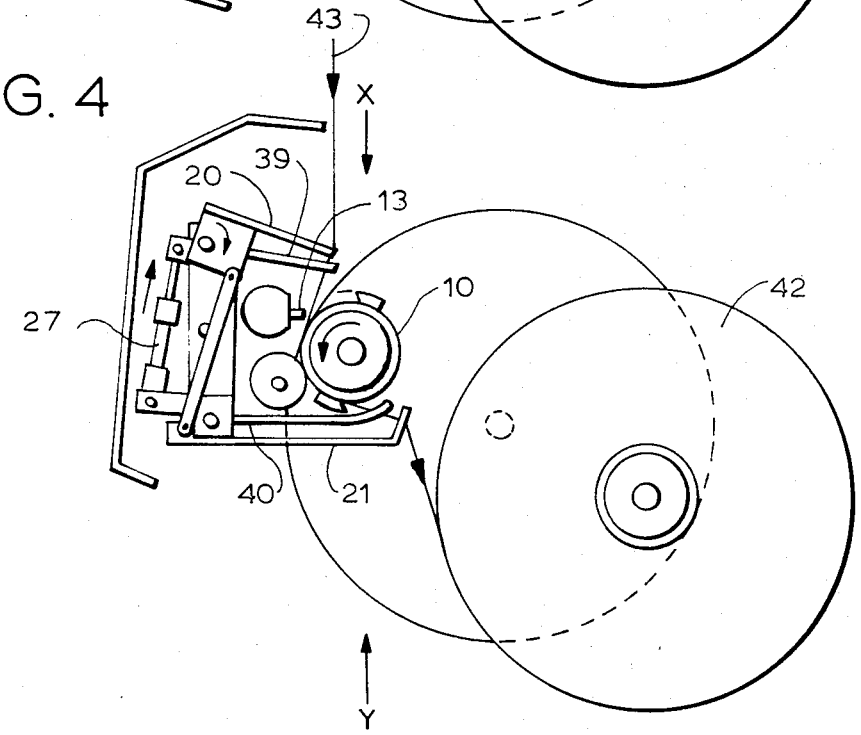
Figure 5:
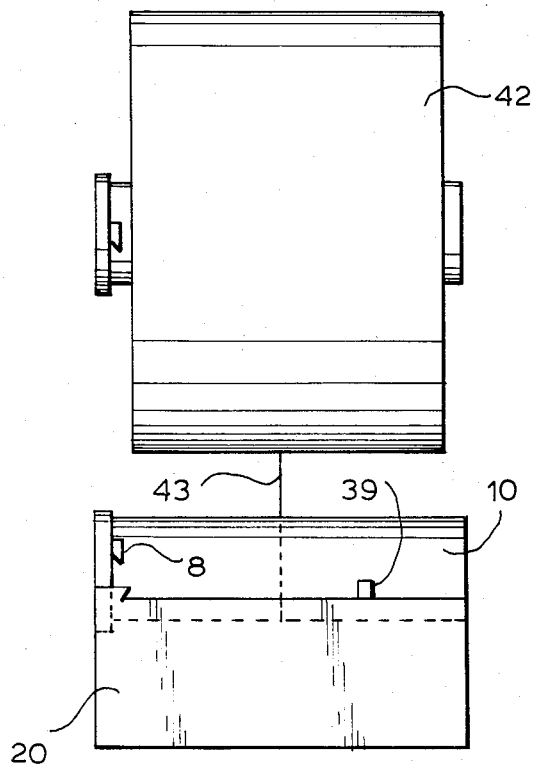
Figure 6:
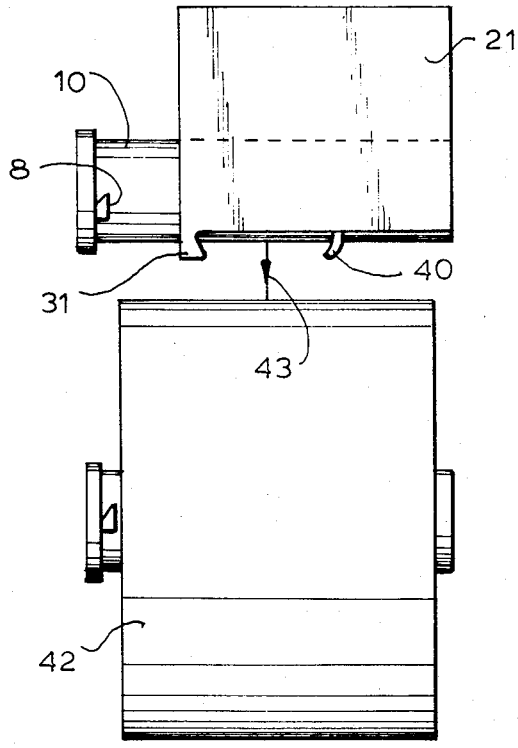
Figure 7:
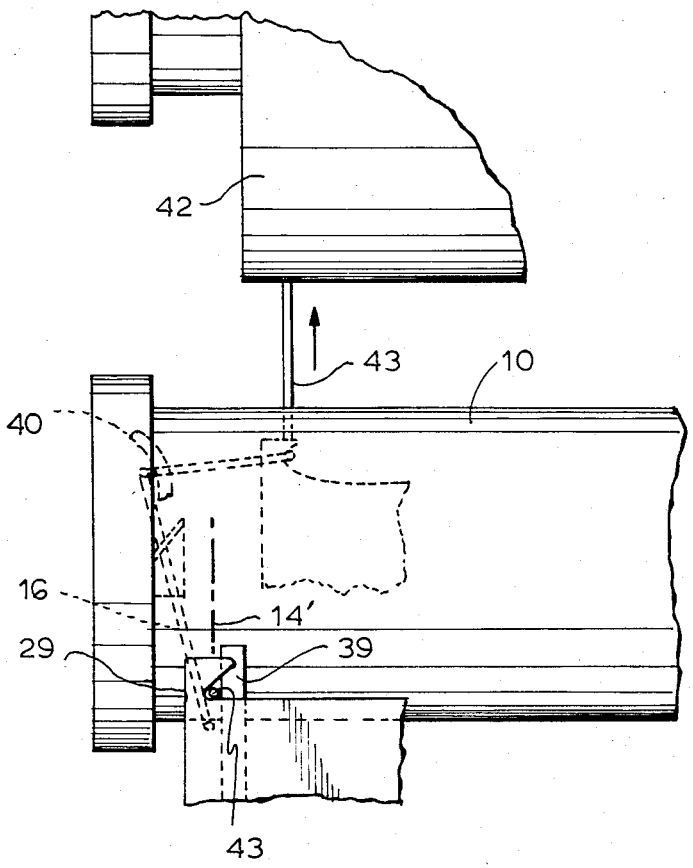
Figure 8:
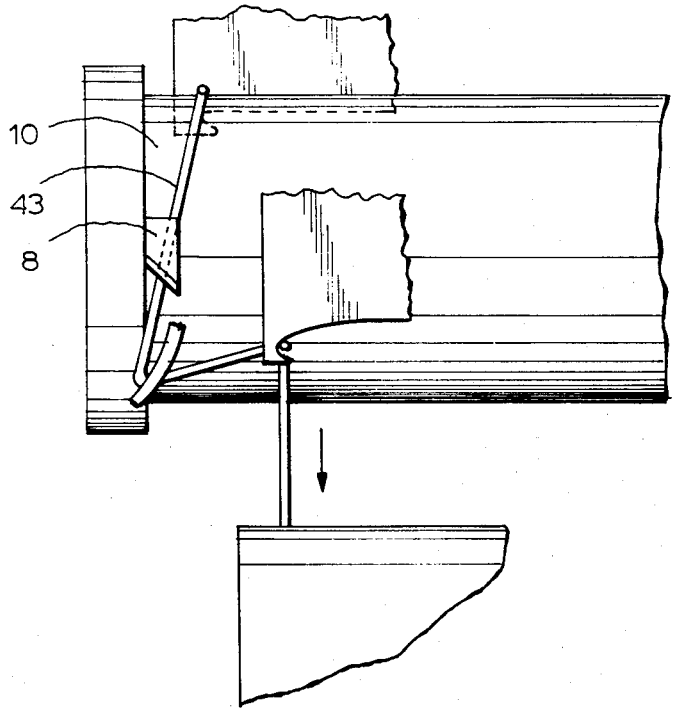

When by actuation of the cylinder 27 the sheet members 20 and 21 and the fingers 39 and 40 connected therewith are moved to the engaging position shown in FIG. 4, the upper sheet member 20 contacts with its front edge 28 formed as a guiding member the thread 43 and lifts it out of the traverse motion thread guide 13. Because of this, the thread moves, regardless of at which position it is lifted from the traverse motion thread guide. The thread starting from this moment no longer reciprocates, but instead runs with seeking the shortest path vertically downwardly, or in other words to the center of the empty sleeve 10. It runs behind the empty sleeve 10 over the front edge 30 of the lower sheet member 21 to the center of the spool 42. FIG. 5, which is a view from above, shows how the upwardly coming thread 43 runs under the empty sleeve 10 centrally to the full spool 42. The upper finger 39 remains in an immovable position, or in other words in the same position as in FIG. 2. FIG. 5 also shows the abutment 29 at the front edge 28 of the upper sheet member 20, the rotatable knife 8 of the clamping pin 6 which is not shown since it is located on the empty sleeve 10. FIG. 6 shows from below the central run of the thread 43 from the empty sleeve 10 to the full spool 42. The lower finger 40 remains in an immovable position, similarly to the finger 39 in FIG. 5. The lower abutment 31 and the cutter 8 can be seen in FIG. 6. By actuating the cylinder-and-piston unit 32, the fingers 39 and 40 move from their inoperative position synchronously in direction toward the end of the sleeve 10, on which the knives 8 and 9 are arranged. Thereby the thread 43 is guided along the guiding members 28 and 30. The upper finger 39 travels up to the abutment 29. The thread in this position which is shown on an enlarged scale in FIG. 7 (a view from above), is guided exactly with small play in a narrow opening which is enclosed by the hook-shaped abutment 29 and the finger 39. It can also be recognized from FIG. 7 that the abutment 29 lies outside the traverse motion region extending to the dash-dot line 14'. It lies over the end region of the sleeve 10, which is identified as a knot winding region. Because of the offset arrangement of the fingers 39, 40, the lower finger 40 runs a little farther than the finger 39 and over the end of the sleeve 10 outwardly. The piece of the thread 43 guided around the sleeve 10 runs therefore inclined over the left edge of the sleeve 10 up to the finger 40, and from there over the abutment 31 of the lower sheet member 21 to the full spool 42. FIG. 8 shows a step for the same time point as FIG. 7, but from below. When the abutment 31 is not available, the thread 43, as can be seen from FIG. 7, runs directly inclined toward the full spool 42 and slides over the edge. There is no longer thread tensioning available, and the subsequently described cutting steps cannot take place.

Figure 9:
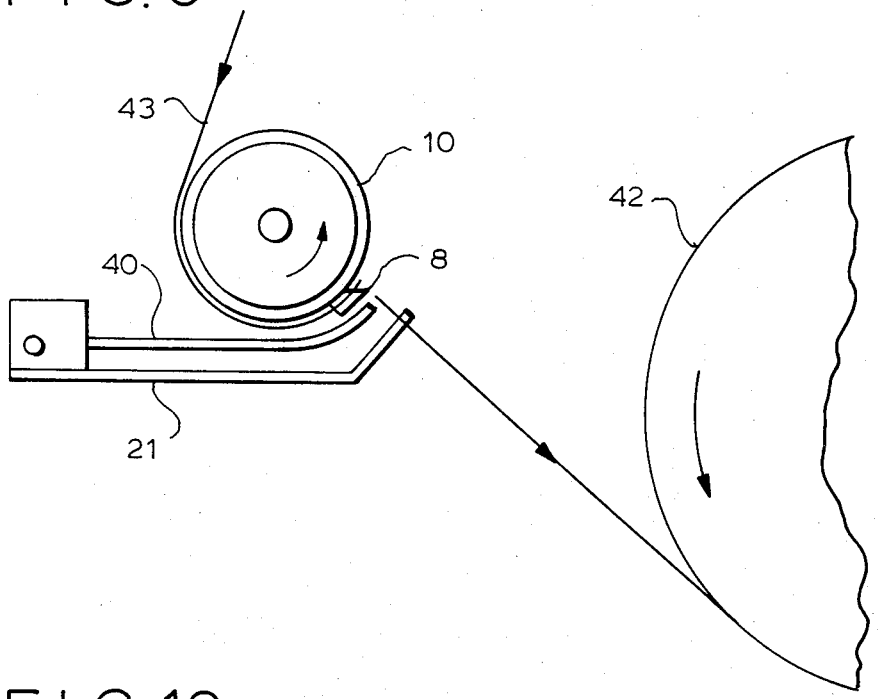

The thread piece running inclined over the edge of the sleeve 10 lies in the upper region (in the vicinity of the finger 39 and the abutment 29) on the sleeve 10 and extends in the lower region (in the vicinity of the finger 40) over the sleeve edge outwardly. It also extends through the plane of the sleeve edge, in which the knife 8, 9 rotatable with the sleeve 10 rotates. As long as the thread reaches this position, it is engaged by one of the rotatable knifes 8, 9 as shown in FIG. 9, clamped between the knife and sleeve, and taken along in the rotary direction of the sleeve 10. Thereby the thread tension increases until the knife separates the thread in the position shown in FIG. 9. One thread end is taken by the spool 42 whose rotation stops gradually. The other thread end sits clamped between the rotatable sleeve 10 and the knife 8 rotatable therewith. Thus the winding step on the sleeve 10 starts.

Figure 10:
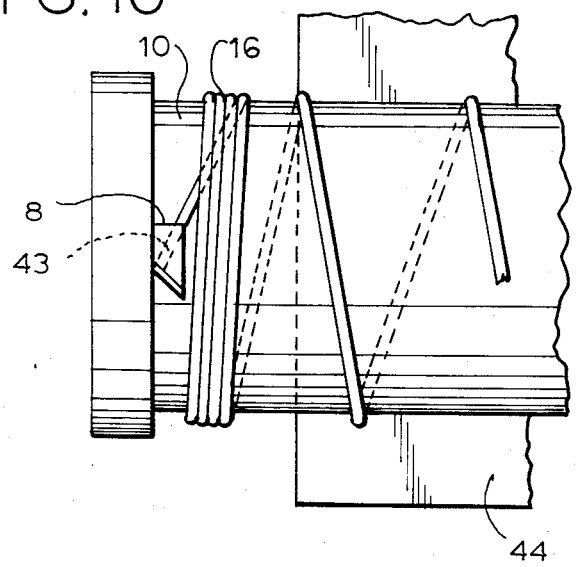
Figure 11:
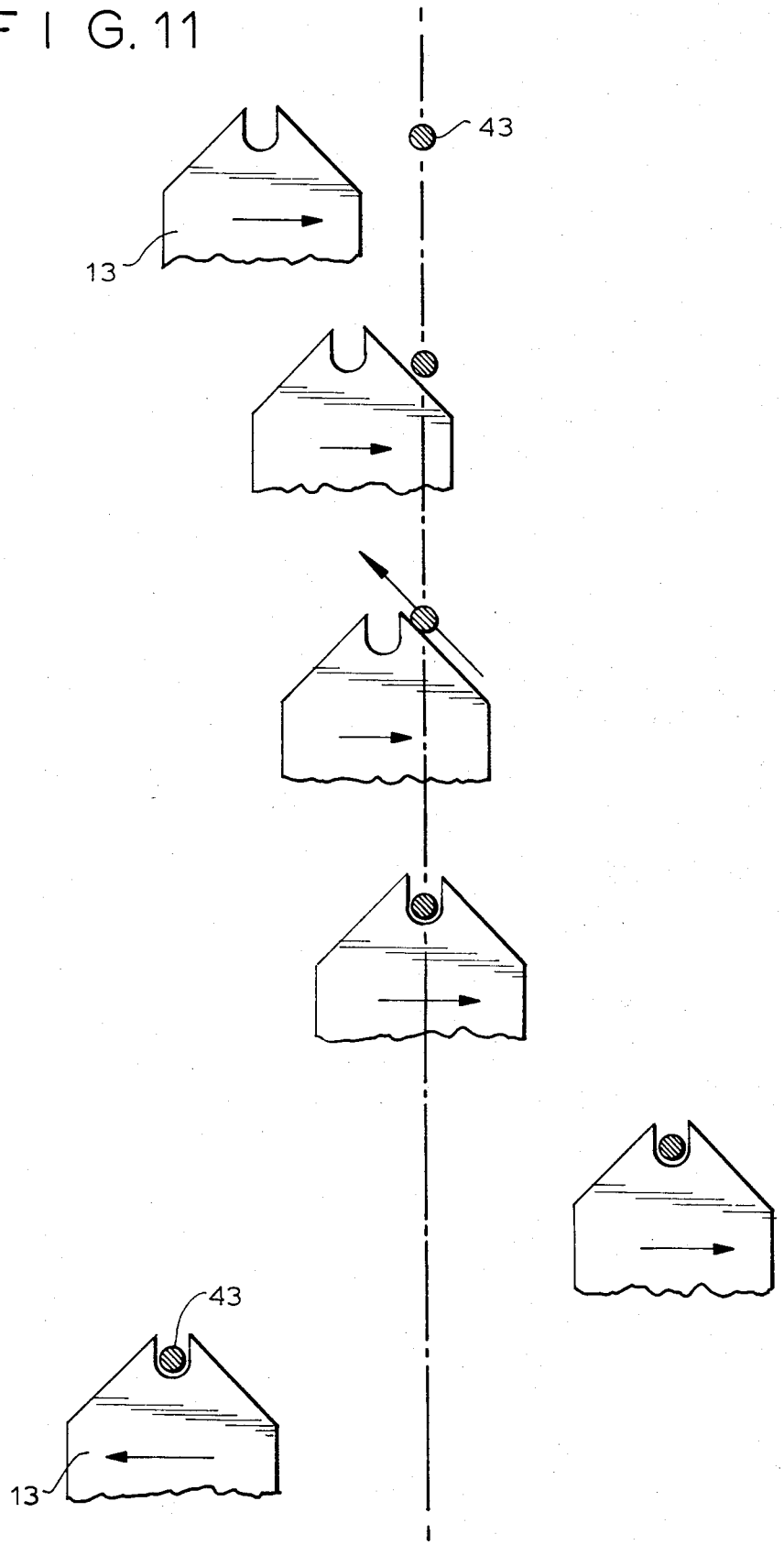
FIG. 11 is a schematic view showing sequential moments of a thread and a thread guide in the machine.

FIG. 10 shows the separated thread 43 clamped between the knife 8 and sleeve 10. Since the thread is now guided by the finger 39 and the abutment 29 (FIG. 7) in the not winding region 16, a small coil begins to form in this region. It winds over the thread end which is clamped under the knife 8 and lies inclined on the sleeve 10, so that it cannot be lost. After a predetermined time, or in other words after the number of windings required for the not winding, the sheet members 20, 21 falls back. The fingers 39, 40 run back in the immovable position. Thereby the position shown in FIG. 3 is again attained. The thread 43 moves, after being released by the finger 39, first free in direction to the center of the traverse motion region and is engaged by the traverse motion thread guide 13 which during the changing step carries out its reciprocating movement without interruption. Now the formation of the spool itself starts. The later shape of the spool is not available at this moment is identified by dash-dot line 44 in FIG. 10. It is thereby clear that the not winding is located outside of the spool itself. The catching of the thread 43 (a known step) is shown in FIG. 11, which illustrates, from above, six sequential in time moments of the thread and the thread guide. The dash-dot line in the center of the drawing identifies the center of the traverse motion region. Because of the lateral inclination of the reciprocating thread guide 13, the thread 43 during first collision with the thread guide 13 is lifted in the groove. It remains lying in there and reciprocates with the thread guide as required for formation of the spool.

The cage 4 includes all parts shown in the drawing, with the exception of the housing 1, the spool switching element 3, as well as arranged on the spool switching element the clamping pins 6, 7, the knives 8, 9, the sleeve 10, and the spool 42. Also, the carriage includes some unimportant parts which are shown in FIG. 1, but not provided with references and not mentioned in the specification, such as for example a protective sheet c and rods a and b mounting the protective sheet, as shown now in the amended FIG. 1. As can be seen from FIG. 2 the carriage 4 is guided on rods d which are mounted in the housing 1. The rod guidance allows displacement of the carriage with increase of the coil diameter, so that the pressing roller 11 abuts against the periphery of the coil.

A knot winding coil is a smaller additional coil including several convolutions, which in addition to the proper yarn winding is brought on the sleeve. The knot winding (known as a transfer tail or reserve winding) serves for facilitating the subsequent working process. When the spool is wound during a subsequent working step, the end of the reserve winding is knotted to the starting portion of the subsequent spool. Thereby a continuous working process is possible without interruption during a spool exchange.

It will be understood that each of the elements described above, or two or more together, may also find a useful application in other types of constructions differing from the types described above.

While the invention has been illustrated and described as embodied in a winding machine for automatic spool exchange, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A winding machine for automatic spool exchange, comprising a spool switching element with two alternatively operating clamping pins for receiving spool sleeves;

means defining a knot winding region;

a traverse motion guiding element defining a traverse motion region;

means shiftable during spool exchange to an operational position and including an upper axis-parallel thread guiding member with an abutment in the knot winding region, a lower axis-parallel thread guiding member with a further abutment in the traverse motion region, a finger displaceable along said upper guiding member to the vicinity of said first-mentioned abutment, and a further finger displaceable outwardly along said lower thread guiding member to over an end of a sleeve;

means for shifting said shiftable means to the operative position; and means for displacing said fingers.

2. A winding machine as defined in claim 1; and further comprising turnable back sheet members, said upper and lower thread guiding members of said shiftable means being formed as front edges of said turnable back sheet members.

3. A winding machine as defined in claim 2; and further comprising guiding rods, said sheet members being connected with said guiding rods.

4. A winding machine as defined in claim 3; and further comprising axially displaceable rings arranged on said guide rods.

5. A winding machine as defined in claim 4, wherein said first-mentioned and further fingers are mounted on said rings and turnable back by turning said guiding rods together with said sheet members.

* * * * *